US010459392B2

(12) United States Patent
Kimura et al.

(10) Patent No.: US 10,459,392 B2
(45) Date of Patent: Oct. 29, 2019

(54) IMAGE FORMING APPARATUS, METHOD OF DISCHARGING TONER, AND PROGRAM FOR DISCHARGING TONER

(71) Applicant: Konica Minolta, Inc., Tokyo (JP)

(72) Inventors: Takenobu Kimura, Hachioji (JP); Shota Sakurai, Machida (JP); Tomohiro Kawasaki, Sagamihara (JP); Wataru Watanabe, Hachioji (JP); Ryoei Ikari, Tokorozawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/270,179

(22) Filed: Feb. 7, 2019

(65) Prior Publication Data

US 2019/0286037 A1 Sep. 19, 2019

(30) Foreign Application Priority Data

Mar. 16, 2018 (JP) ..... 2018-049585

(51) Int. Cl.
*G03G 15/00* (2006.01)
*G03G 21/00* (2006.01)

(52) U.S. Cl.
CPC ..... *G03G 15/553* (2013.01); *G03G 21/0005* (2013.01)

(58) Field of Classification Search
CPC .... G03G 15/553; G03G 15/556; G03G 15/50; G03G 21/0005
See application file for complete search history.

(56) References Cited

U.S. PATENT DOCUMENTS

2013/0011145 A1* 1/2013 Nishimura ..... G03G 15/553 399/12

FOREIGN PATENT DOCUMENTS

JP 2006-011482 A 1/2006

* cited by examiner

*Primary Examiner* — Walter L Lindsay, Jr.
*Assistant Examiner* — Arlene Heredia
(74) *Attorney, Agent, or Firm* — Lucas & Mercanti, LLP

(57) ABSTRACT

An image forming apparatus includes: an image carrier that carries a toner image; a developing part that accommodates two-component developer containing toner and a carrier, and supplies the toner to the image carrier; a transferor that transfers the toner image on the image carrier onto paper; a cleaning member that removes the toner remaining on the image carrier; and a hardware processor that controls toner discharge operation in the developing part according to a toner discharge condition, in which the hardware processor sets the toner discharge condition so that a replacement time of the cleaning member overlaps with a replacement time of another consumable.

9 Claims, 10 Drawing Sheets

IMAGE FORMING APPARATUS, METHOD OF DISCHARGING TONER, AND PROGRAM FOR DISCHARGING TONER

The entire disclosure of Japanese patent Application No. 2018-049585, filed on Mar. 16, 2018, is incorporated herein by reference in its entirety.

BACKGROUND

Technological Field

The present invention relates to an electrophotographic image forming apparatus, a method of discharging toner, and a program for discharging toner.

Description of the Related Art

Generally, in an image forming apparatus (e.g., a printer, a copier, a facsimile machine, and a multifunction machine) using electrophotographic process technology, an electrostatic latent image is formed on the surface of a photoreceptor by applying light based on input image data on a uniformly charged photoreceptor (e.g., photosensitive drum) (exposure). The electrostatic latent image is then visualized and a toner image is formed by toner supplied from a developing part to the photoreceptor on which the electrostatic latent image is formed. An image is formed on paper by the toner image transferred onto the paper directly or indirectly via an intermediate transfer body (e.g., intermediate transfer belt) and heated and pressurized at a fixer.

It is known that, when two-component developer containing toner and a carrier is used in the above-described electrophotographic image forming apparatus, an external additive is buried under a toner surface, or detached from the toner with agitation of the toner and the carrier in the developing part to deteriorate the toner. In particular, when an image is formed with a low coverage (e.g., coverage of 5% or less), the toner is kept agitated in the developing part without being replaced, and thus the toner is remarkably deteriorated. The deterioration of the toner deteriorates a charge characteristic, and then may cause image disturbance, toner scattering, and toner spilling. A traditional image forming apparatus thus forcibly discharges toner stressed in the developing part (hereinafter, referred to as "deteriorated toner"). It should be noted that new toner is appropriately resupplied according to a toner amount in the developing part. When the charge amount of the toner reaches a predetermined value or less, the developer is usually replaced.

In the present specification, a numerical value representing a coverage corresponds to a printing rate converted for the case of image formation on A4 size paper, and represents a toner consumption amount per sheet. In addition, the coverage corresponding to the toner consumption amount at the image formation is referred to as a "document coverage", and a coverage corresponding to the toner discharge amount of a deteriorated toner is referred to as a "discharge coverage".

A cleaning unit for an image carrier removes the deteriorated toner discharged from the developing part. The cleaning member provided in the cleaning unit is worn when the toner passes and an external additive pass through the cleaning member. When a toner passage amount reaches a predetermined value or more, the cleaning member is usually replaced.

As described above, the performance of consumables including the developer and the cleaning member is deteriorated with image formation. The consumables then come to the end of the life, and are replaced. In the case, a service man visits the installation site to replace the consumables. Here, when each of lives of the developer and the cleaning member is set to be replaced at the same time, the two can be replaced at the same time (e.g., see JP 2006-11482 A). JP 2006-11482 A discloses overlapping of the lives of consumables (e.g., an image carrier, a charging device, a carrier of a two-component developer, and a cleaning member) in an image forming apparatus.

Unfortunately, image formation with a low coverage and increased discharge amount of deteriorated toner cause a cleaning member to come to the end of the life earlier than a developer, leading to not overlapping replacement times. When the replacement times of the developer and the cleaning member is close but not at the same time, a service man is required to pay two visits in a short period, or to replace one that has an earlier replacement time and accordingly replace the other as well in order to reduce the number of visits. This increases running cost (including maintenance cost and consumable cost) compared to that in the case where the replacement times of the developer and the cleaning member overlap with each other.

SUMMARY

An object of the invention is to provide an image forming apparatus, a method of discharging toner, and a program for discharging toner that are capable of reducing the running cost.

To achieve the abovementioned object, according to an aspect of the present invention, an image forming apparatus reflecting one aspect of the present invention comprises: an image carrier that carries a toner image; a developing part that accommodates two-component developer containing toner and a carrier, and supplies the toner to the image carrier, a transferor that transfers the toner image on the image carrier onto paper; a cleaning member that removes the toner remaining on the image carrier; and a hardware processor that controls toner discharge operation in the developing part according to a toner discharge condition, in which the hardware processor sets the toner discharge condition so that a replacement time of the cleaning member overlaps with a replacement time of another consumable.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described in detail with reference to the drawings. However, the scope of the invention is not limited to the disclosed embodiments.

Figure 1:
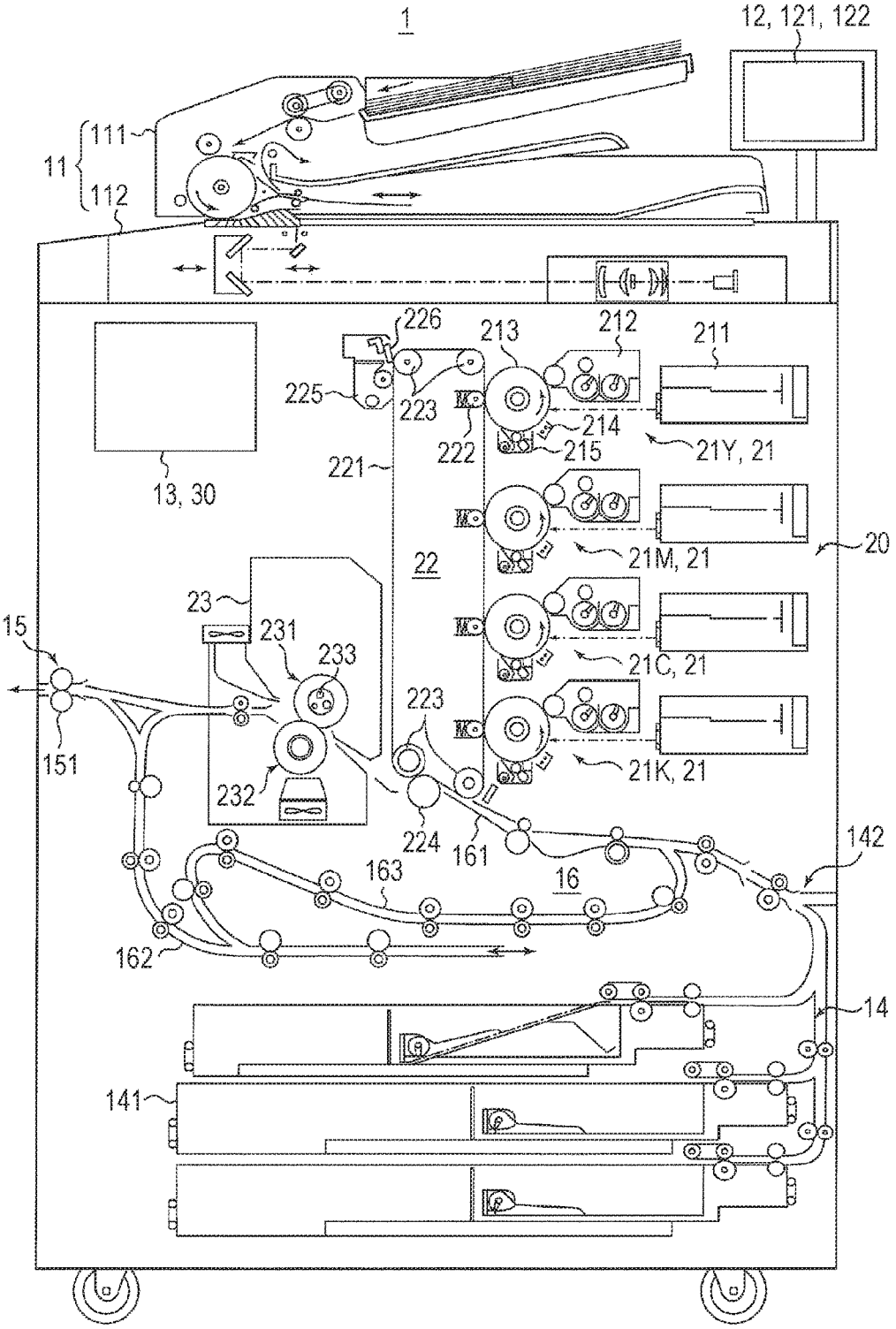
FIG. 1 illustrates the overall configuration of an image forming apparatus according to an embodiment.
Figure 2:
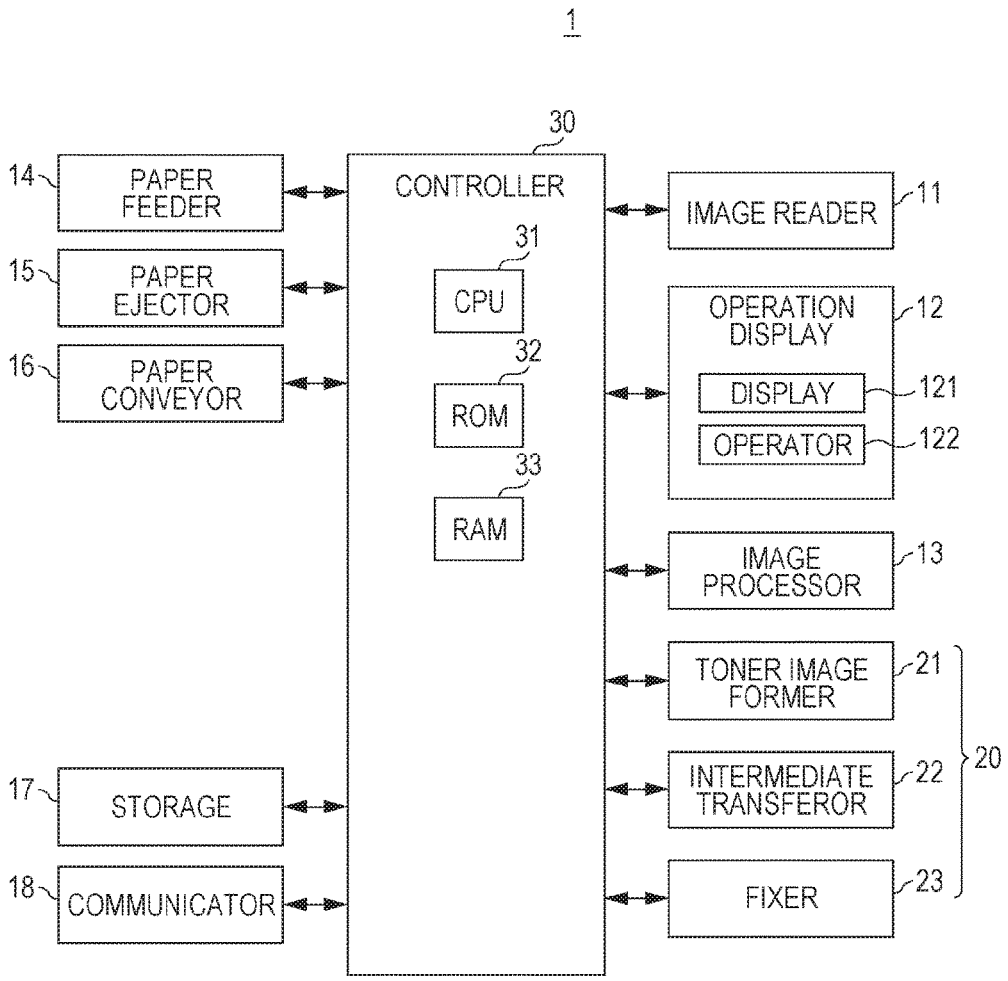
FIG. 2 illustrates main parts of a control system of the image forming apparatus.

FIG. 1 illustrates the overall configuration of an image forming apparatus 1 according to the embodiment. FIG. 2 illustrates main parts of a control system of the image forming apparatus 1.

The image forming apparatus 1 illustrated in FIGS. 1 and 2 is an intermediate-transfer-type color image forming apparatus utilizing an electrophotographic process technology. The image forming apparatus 1 primarily transfers toner images of each color: Y (yellow), M (magenta), C (cyan), and K (black) formed on photosensitive drums 213 onto an intermediate transfer belt 221. The image forming apparatus 1 superimposes the toner images of each of the four colors on the intermediate transfer belt 221, and secondarily transfers the superimposed image onto paper. In such a way, the image forming apparatus 1 forms an image. The image forming apparatus 1 of the embodiment adopts a vertical tandem system. In the vertical tandem system, the photosensitive drums 213 for four colors of CMYK are arranged in series in the traveling direction (vertical direction) of the intermediate transfer belt 221, and the toner images of each color are sequentially transferred onto the intermediate transfer belt 221 in one procedure.

As illustrated in FIGS. 1 and 2, the image forming apparatus 1 includes an image reader 11, an operation display 12, an image processor 13, a paper feeder 14, a paper ejector 15, a paper conveyor 16, a storage 17, a communicator 18, an image former 20, and a controller 30.

The image reader 11 includes an automatic document feeding device 111 called an auto document feeder (ADF) and a document image scanning device 112 (scanner).

The automatic document feeding device 111 conveys a document placed in a document tray with a conveyance mechanism to the document image scanning device 112. The automatic document feeding device 111 enables continuous reading of multiple document images (including images on both sides) placed in the document tray.

The document image scanning device 112 reads a document image by optically scanning a document conveyed from the automatic document feeding device 111 with the document on contact glass or a document placed on the contact glass, and imaging reflected light from the document on a light receiving surface of a charge coupled device (CCD) sensor. The image reader 11 generates input image data based on a reading result from the document image scanning device 112. The input image data is subjected to predetermined image processing in the image processor 13.

The operation display 12 can adopt, for example, a flat panel display including a flat panel display with a touch panel, such as a liquid crystal display and an organic EL display. The operation display 12 includes a display 121 and an operator 122.

The display 121 displays, for example, various operation screens, image conditions, and an operation state of each function according to a display control signal input from the controller 30.

The operator 122 includes various operation keys such as a numeric key and a start key. The operator 122 receives various input operations from a user, and outputs operation signals to the controller 30. The user can operate the operation display 12 to perform setting related to image formation, such as document setting, image quality setting, magnification setting, applied setting, output setting, and paper setting.

The image processor 13 includes a circuit for performing digital image processing according to initial setting or user setting on the input image data. For example, the image processor 13 corrects gradation based on gradation correcting data under the control of the controller 30. The image processor 13 also performs various pieces of correction processing, such as color correction, shading correction, and density correction, on the input image data. The image former 20 is controlled based on the image data subject to these pieces of processing.

The image former 20 includes a toner image former 21, an intermediate transferor 22, and a fixer 23. The toner image former 21 forms a toner image with color toner of each of Y, M, C, and K components based on the input image data. The intermediate transferor 22 transfers the toner image formed by the toner image former 21 onto paper. The fixer 23 fixes the toner image transferred onto the paper.

The toner image former 21 includes four toner image formers 21Y, 21M, 21C, and 21K respectively for Y, M, C, and K components. The toner image formers 21Y, 21M, 21C, and 21K have the same configuration. For the sake of illustration and explanation, common constituents are denoted by the same reference sign. When necessary to distinguish the components, reference characters Y, M, C, and K will be added to the reference sign. In FIG. 1, only constituents of the toner image former 21Y for the Y component are given reference signs, and reference signs for the other constituents of the toner image formers 21M, 21C and 21K are omitted.

The toner image former 21 includes an exposure device 211, a developing device 212, the photosensitive drum 213, a charging device 214, and a drum cleaning device 215. The toner image former 21 may include a charge eliminator for removing remaining charges remaining on a surface of the photosensitive drum 213 after primary transfer.

The photosensitive drum 213 is an organic photo-conductor (OPC) of a negative charge type. In the organic photoreceptor, an under coat layer (UCL), a charge generation layer (CGL), and a charge transport layer (CU) are sequentially laminated on a peripheral surface of, for example, an aluminum conductive cylinder (aluminum tube stock). The charge generation layer includes an organic semiconductor in which a charge generation material (e.g., phthalocyanine pigment) is dispersed in resin binder (e.g., polycarbonate). The charge generation layer generates a pair of positive and negative charges upon exposed by the exposure device 211. The charge transport layer includes a hole transporting material (electron donating nitrogen-containing compound)

dispersed in resin binder (e.g., polycarbonate resin). The charge transport layer transports a positive charge that has generated in the charge generation layer to the surface of the charge transport layer.

The charging device 214 includes a corona discharge generator, such as a scorotron charging device and a corotron charging device. The charging device 214 uniformly charges the surface of the photosensitive drum 213 to negative polarity by corona discharge.

For example, the exposure device 211 includes a light emitting diode (LED) print head including an LED array, an LPH driver (driver IC), and a lens array. In the LED array, a plurality of LEDs is linearly arranged. The LPH driver drives individual LEDs. The lens array images light emitted from the LED array on the photosensitive drum 213. One LED of the LED array corresponds to one dot of the image.

The exposure device 211 applies light corresponding to an image of each color component to the photosensitive drum 213. The light application generates positive charges in the charge generation layer of the photosensitive drum 213. The positive charges are transported to the surface of the charge transport layer to neutralize surface charges (negative charges) of the photosensitive drum 213. The potential difference from the surroundings forms an electrostatic latent image of each color component on the surface of the photosensitive drum 213.

The developing device 212 accommodates developer of each color component (in the embodiment, two-component developer containing toner and a magnetic carrier). The developing device 212 visualizes the electrostatic latent image to form the toner image by attaching the toner of each color component on the surface of the photosensitive drum 213. Specifically, a developing bias voltage is applied to a developer carrier (reference sign omitted; e.g., a developing roller), and an electric field is formed between the photosensitive drum 213 and the developer carrier. The potential difference between the photosensitive drum 213 and the developer carrier causes charged toner on the developer carrier to move and attach to an exposed portion on the surface of the photosensitive drum 213.

The drum cleaning device 215 includes a drum cleaning blade (reference sign omitted) that is in slide contact with the surface of the photosensitive drum 213, and removes transfer residual toner remaining on the surface of the photosensitive drum 213 after the primary transfer.

The intermediate transferor 22 includes the intermediate transfer belt 221, a primary transfer roller 222, a plurality of support rollers 223, a secondary transfer roller 224, and a belt cleaning device 225.

The intermediate transfer belt 221 is an image carrier that carries the toner image. The intermediate transfer belt 221 includes an endless belt, and is looped around the plurality of support rollers 223. At least one of the plurality of support rollers 223 is a driving roller, and the others are driven rollers. Rotation of the driving roller causes the intermediate transfer belt 221 to travel at a constant speed.

The primary transfer roller 222 is disposed on the inner-peripheral-surface side of the intermediate transfer belt 221 facing the photosensitive drum 213 for each color component. A primary transfer nip (hereinafter referred to as a "primary transferor") for transferring the toner image from the photosensitive drum 213 to the intermediate transfer belt 221 is formed by pressure contact of the primary transfer roller 222 against the photosensitive drum 213 with the intermediate transfer belt 221 sandwiched therebetween.

The secondary transfer roller 224 is disposed on the outer-peripheral-surface side of the intermediate transfer belt 221 facing one of the plurality of support rollers 223. The support roller 223 disposed facing the secondary transfer roller 224 among the plurality of support rollers 223 is called a backup roller. A secondary transfer nip (hereinafter referred to as a "secondary transferor") for transferring a toner image from the intermediate transfer belt 221 to paper is formed by pressure contact of the secondary transfer roller 224 against the backup roller with the intermediate transfer belt 221 sandwiched therebetween. It should be noted that a structure (so-called belt-type secondary transfer unit) in which a secondary transfer belt is looped around the plurality of support rollers including the secondary transfer roller may be adopted instead of the secondary transfer roller 224.

In the primary transferor, the toner image on the photosensitive drum 213 is primarily transferred onto the intermediate transfer belt 221 sequentially over one another. Specifically, the toner image is electrostatically transferred onto the intermediate transfer belt 221 by applying primary transfer bias to the primary transfer roller 222 and imparting a charge of a polarity opposite to that of the toner to the back-surface side (the side abutting on the primary transfer roller 222) of the intermediate transfer belt 221.

Thereafter, when paper passes through the secondary transferor, the toner image on the intermediate transfer belt 221 is secondarily transferred to the paper. Specifically, the toner image is electrostatically transferred onto the paper by applying secondary transfer bias to the secondary transfer roller 224 and imparting a charge of a polarity opposite to that of the toner to the back-surface side (the side abutting on the secondary transfer roller 224) of the paper. The paper onto which the toner image is transferred is conveyed toward the fixer 23.

The belt cleaning device 225 includes a belt cleaning blade 226 in slide contact with the surface of the intermediate transfer belt 221. The belt cleaning device 225 removes transfer residual toner remaining on the surface of the intermediate transfer belt 221 after the secondary transfer. The belt cleaning device 225 removes the toner image formed on the intermediate transfer belt 221 during discharge of deteriorated toner.

The fixer 23 includes an upper fixer 231, a lower fixer 232, a heating source 233, and a pressure contact separation part (not illustrated). The upper fixer 231 includes a fixing-surface-side member disposed on the side of the fixing surface (surface on which the toner image is formed) of the paper. The lower fixer 232 includes a back-surface-side support disposed on the side of the back surface (surface opposite to the fixing surface) of the paper. The heating source 233 heats the fixing-surface-side member. The pressure contact separation part brings the back-surface-side support into pressure contact with the fixing-surface-side member.

For example, when the upper fixer 231 is of a roller heating type, a fixing roller corresponds to the fixing-surface-side member, and when the upper fixer 231 is of a belt heating type, a fixing belt corresponds to the fixing-surface-side member. In addition, for example, when the lower fixer 232 is of a roller pressurization type, a pressurizing roller corresponds to the back-surface-side support, and when the lower fixer 232 is of a belt pressurization type, a pressurizing belt corresponds to the back-surface-side support. FIG. 1 illustrates the upper fixer 231 of the roller heating type and the lower fixer 232 of the roller pressurization type.

The upper fixer 231 includes an upper fixer driver (not illustrated) for rotating the fixing-surface-side member. The fixing-surface-side member rotates (travels) at a predetermined speed by putting operation of the upper fixer driver under the control of the controller 30. The lower fixer 232 includes a lower fixer driver (not illustrated) for rotating the back-surface-side support. The back-surface-side support rotates (travels) at a predetermined speed by putting operation of the upper fixer driver under the control of the controller 30. It should be noted that, when the fixing-surface-side member follows rotation of the back-surface-side support, the upper fixer driver is unnecessary.

The heating source 233 is disposed in or near the fixing-surface-side member. The controller 30 controls output of the heating source 233 such that fixing temperature reaches fixing control temperature based on a detection result from a fixing temperature detector (not illustrated) disposed near the fixing-surface-side member. The fixing-surface-side member is heated to be held at the fixing control temperature (e.g., fixing target temperature and idling temperature) by putting output of the heating source 233 under the control of the controller 30.

The pressure contact separation part (not illustrated) presses the back-surface-side support toward the fixing-surface-side member. For example, the pressure contact separation part abuts on both ends of a shaft supporting the back-surface-side support, and presses the both ends of the shaft independently. This configuration enables adjustment of the balance of nip pressure of the fixing nip in the axial direction. The fixing nip for nipping and conveying paper is formed by putting operation of the pressure contact separation part (not illustrated) under the control of the controller 30 and bringing the back-surface-side support into pressure contact with the fixing-surface-side member.

The paper having the secondarily transferred toner image and conveyed along a paper path is heated and pressurized when passing through the fixer 23. This operation fixes the toner image on the paper.

The paper feeder 14 includes a paper feeding tray 141 and a manual paper feeder 142. The paper feeding tray 141 accommodates sheets of paper (standard paper and special paper) identified based on, for example, the basis weight and the size while assorting the sheets of paper based on preset paper types. A plurality of paper feeding roller units are disposed in the paper feeding tray 141 and the manual paper feeder 142. In addition, a large-capacity external paper feeding device (not illustrated) can be connected to the manual paper feeder 142. The paper feeder 14 sends the paper fed from the paper feeding tray 141 or the manual paper feeder 142 to the paper conveyor 16.

The paper ejector 15 includes, for example, a paper ejecting roller unit 151, and ejects the paper sent from the paper conveyor 16 to the outside of the machine.

The paper conveyor 16 includes a main conveyor 161, a switchback conveyor 162, a back-surface-printing conveyor 163, and a paper-path switch (not illustrated). A part of the paper conveyor 16 may be incorporated into one unit together with, for example, the fixer 23, and may be detachably attached to the image forming apparatus 1.

The main conveyor 161 includes a plurality of conveyance roller units including a loop roller unit and a resist roller unit as a paper conveyance element for nipping and conveying paper. The main conveyor 161 conveys the paper fed from the paper feeding tray 141 or the manual paper feeder 142 to pass the paper to the image former 20 (the intermediate transferor 22 and the fixer 23), and conveys the paper sent from the image former 20 (fixer 23) toward the paper ejector 15 or the switchback conveyor 162.

The switchback conveyor 162 once stops the paper sent from the fixer 23 to reverse the conveyance direction of the paper, and conveys the paper to the paper ejector 15 or the back-surface-printing conveyor 163.

The back-surface-printing conveyor 163 circulates and conveys the paper switched back by the switchback conveyor 162 to the main conveyor 161. The paper is passed through the main conveyor 161 with the back surface being subject to image formation.

The paper-path switch (not illustrated) switches the paper path depending on whether to eject the paper sent from the fixer 23 as it is, whether to eject the paper with reversal, or whether to convey the paper to the back-surface-printing conveyor 163. Specifically, the controller 30 controls operation of the paper-path switch (not illustrated) based on a processing content (e.g., single/double-side printing and face-up/face-down paper ejection) of the image forming processing.

The main conveyor 161 conveys the paper fed from the paper feeder 14 to the image former 20. When the paper passes through the transfer nip, the toner image on the photosensitive drum 213 is then collectively transferred onto the first surface (front surface) of the paper, and the fixer 23 performs fixing processing. The paper ejector 15 ejects the paper on which the image is formed to the outside of the machine. In the case of forming images on both surfaces of the paper, the paper having the image formed on the first surface is sent to the switchback conveyor 162, and reversed by returning to the main conveyor 161 through the back-surface-printing conveyor 163, whereby an image is formed on the second surface (back surface).

The controller 30 includes a central processing unit (CPU) 31, a read only memory (ROM) 32, and a random access memory (RAM) 33. The CPU 31 serves as an arithmetic/control device. The ROM 32 serves as a main storage device. Basic programs and basic setting data are stored in the ROM 32. The CPU 31 reads a program according to a processing content from the ROM 32 or the storage 17, decompresses the program in the RAM 32, executes the decompressed program, whereby the CPU 31 centrally controls operation of each block of the image forming apparatus 1.

It should be noted that an electronic circuit such as a digital signal processor (DSP), an application specific integrated circuit (ASIC), and a programmable logic device (PLD), which are provided according to processing, may execute a part or all of the processing to be executed by the controller 30.

For example, the storage 17 is an auxiliary storage device including a nonvolatile semiconductor memory (so-called flash memory) or a hard disk drive. The storage 17 may be a disk drive that drives an optical disc, such as a compact disc (CD) and a digital versatile disc (DVD), and an optical magnetic disk such as a magneto-optical disk (MO) to read and write information. For example, the storage 17 may also be a memory card such as a USB memory and an SD card.

The storage 17 stores, for example, a toner discharge control program and a lookup table. The lookup table is referred to when operation of each block of the image forming apparatus 1 is controlled. These pieces of data may be stored in the ROM 32. The toner discharge control program is provided via, for example, a computer-readable portable storage medium (including an optical disc, an optical magnetic disk, and a memory card) in which the program is stored. For example, the toner discharge control program may be provided by being downloaded from a server holding the program via a network.

The communicator 18 includes various interfaces such as a network interface card (NIC), a modulator-demodulator (MODEM), and a universal serial bus (USB). The communicator 18 can adopt a communication interface for short-distance wireless communication such as near field communication (NFC) and Bluetooth (registered trademark). The controller 30 transmits and receives various kinds of information to and from an external device (e.g., a personal computer) connected to a network such as a wired/wireless local area network (LAN) via the communicator 18. For example, the controller 30 receives print job data transmitted from the external device, and creates input image data based on the print job data. The print job data is described in a predetermined page description language (PDL), and includes, for example, data of image objects such as graphics and photographs and data of text objects such as characters and symbols.

In the image forming apparatus 1, an external additive is buried under a toner surface, or detached from toner with agitation of the toner and a carrier in the developing device 212. This deteriorates the toner. The image forming apparatus 1 thus forcibly discharges the deteriorated toner that has been stressed in the developing device 212 according to a predetermined toner discharge condition, and replace the deteriorated toner with new toner. It should be noted that the new toner is appropriately resupplied according to a toner amount (toner density) in the developing device 212. The controller 30 controls toner discharge operation.

Here, the toner discharge condition includes a condition related to a toner discharge amount in the toner discharge operation and a condition related to toner discharge timing when the toner discharge operation is performed.

The image forming apparatus 1 has the first toner discharge mode (hereinafter referred to as a "RFP mode") and the second toner discharge mode (hereinafter referred to as a "toner refresh mode") as modes for performing the toner discharge operation. The first toner discharge mode is performed between sheets of paper at the first toner discharge timing (for each formation of one image, in the embodiment). The second toner discharge mode is performed between jobs at the second toner discharge timing.

In the RFP mode, a toner image for discharging deteriorated toner (hereinafter referred to as a "discharging toner image") is formed on the intermediate transfer belt 221 between a toner image transferred onto the preceding paper and a toner image transferred onto the subsequent paper (so-called between sheets of paper) to forcibly discharge the deteriorated toner. The discharging toner image passes through the transferor during a period from the time when the preceding paper has passed through the secondary transferor to the time when the subsequent paper reaches the secondary transferor (so-called between sheets of paper). The discharging toner image is thus not transferred onto the paper, and recovered by the belt cleaning device 225.

The toner discharge operation in the RFP mode is performed between sheets of paper at substantially every printing. In the RFP mode, the toner discharge amount (discharge coverage) is determined based on the document coverage at the image formation performed in a predetermined period (e.g., period from the previous coverage calculation to this coverage calculation). That is, the discharging toner image of the difference between the amount of deteriorated toner assumed to be generated in the predetermined period and the amount of toner consumed by the image formation is formed and discharged.

In the RFP mode, the toner discharge amount may be controlled by calculating an amount corresponding to the difference between an average document coverage in the predetermined period and a target coverage, or by calculating amounts corresponding to the difference between the target coverage and the document coverage one by one and integrating the amounts. Here, the target coverage is a degree of coverage with which the toner in the developing device 212 is appropriately replaced and the deteriorated toner does not cause any trouble. Generally, the document coverage of 5% or more is considered not to generate the deteriorated toner. That is, the target coverage in the case is 5%.

In the RFP mode of the embodiment, when the document coverage of 5% or less on average (equal to or less than the target coverage) at image formation performed in a predetermined period is detected, a black solid toner band (discharging toner image) is formed between sheets of paper. At the time, the toner is discharged such that the total of the toner consumption amount in the image formation and the deteriorated-toner discharge amount corresponds to the 5% coverage (target coverage). That is, a condition of "target coverage of 5%" is set as a condition related to a toner discharge amount, which is one of the toner discharge conditions.

The toner discharge operation in the toner refresh mode is performed with a longer period (e.g., at each 200 kp printing) than that of the RFP mode. The toner refresh mode is effective when the toner amount that can be discharged in the RFP mode is restricted and the deteriorated toner cannot be sufficiently discharged.

In the toner refresh mode, after the number of printed sheets of paper reaches the predetermined number when a print job giving an instruction for a series of pieces of image formation is in progress and the print job is finished (so-called between jobs), the discharging toner image is formed on the intermediate transfer belt 221 to forcibly discharge the deteriorated toner. In the case, a larger amount of deteriorated toner is discharged than in the RFP mode, and new toner is resupplied with the discharge of the deteriorated toner.

In the toner refresh mode, a developer deteriorates faster than in the case where toner is discharged in the RFP mode in a period until the toner discharge operation is performed, but once the toner is discharged, a developer life is rapidly recovered. In contrast, the cleaning blade 226 deteriorates more slowly than in the case where toner is discharged in the RFP mode in a period until the toner is discharged, but once the toner is discharged, the cleaning blade 226 deteriorates rapidly.

In the toner refresh mode, for example, when the document coverage at image formation performed in a predetermined period is detected to be 5% or less (equal to or less than the target coverage), toner is discharged such that integration is performed to an amount corresponding to the difference from 5% and toner in discharge insufficiency is collectively discharged at a time point (second toner discharge timing).

It should be noted that the RFP mode and the toner refresh mode may be used individually or in combination.

Here, when the document coverage is equal to or greater than the target coverage and the toner is appropriately consumed by image formation, no deteriorated toner is considered to be generated. That is, when the toner consumption amount per sheet is equal to or less than a predetermined amount, in other words, when the document coverage is equal to or less than the target coverage, toner needs to be discharged in the RFP mode or the toner refresh mode. The toner discharge amount is set such that the toner consumption amount per sheet is equal to or greater than a predetermined amount, that is, the coverage per sheet is equal to or greater than the target coverage. In the embodiment, the case of the target coverage of 5% will be described.

By the way, a developer life (printable number) is calculated based on a toner charge amount. The toner charge amount is determined by the degree of deterioration of a carrier and toner. When the document coverage is lower than the target coverage and an image with low coverage is formed, the degree of toner deterioration is increased, so that the developer life is determined by the degree of toner deterioration. When the toner charge amount of the developer reaches a predetermined value or less, the developer is usually replaced.

In contrast, the cleaning blade 226 is worn when an external additive of the toner passes through the cleaning blade 226. A passage amount of toner thus determines a life of the cleaning blade 226. In particular, the deteriorated toner discharged in the RFP mode or the toner refresh mode remains on the intermediate transfer belt 221 without being transferred onto paper, thereby putting a heavy burden on the cleaning blade 226. Progression of the wear of the cleaning blade 226 causes incomplete removal of untransferred toner remaining on the intermediate transfer belt 221, and may lead to poor cleaning. When the toner passage amount reaches a predetermined value or more, the cleaning blade 226 is usually replaced.

As described above, the performance of the developer and the cleaning blade 226 is deteriorated with the use of the image forming apparatus 1. When coining to the end of the life, the developer and the cleaning blade 226 are replaced. In the case, a service man visits the installation site to perform replacement. Here, when each of lives of the developer and the cleaning blade 226 is set to be replaced at the same time, the two can be replaced at the same time.

Figure 3:
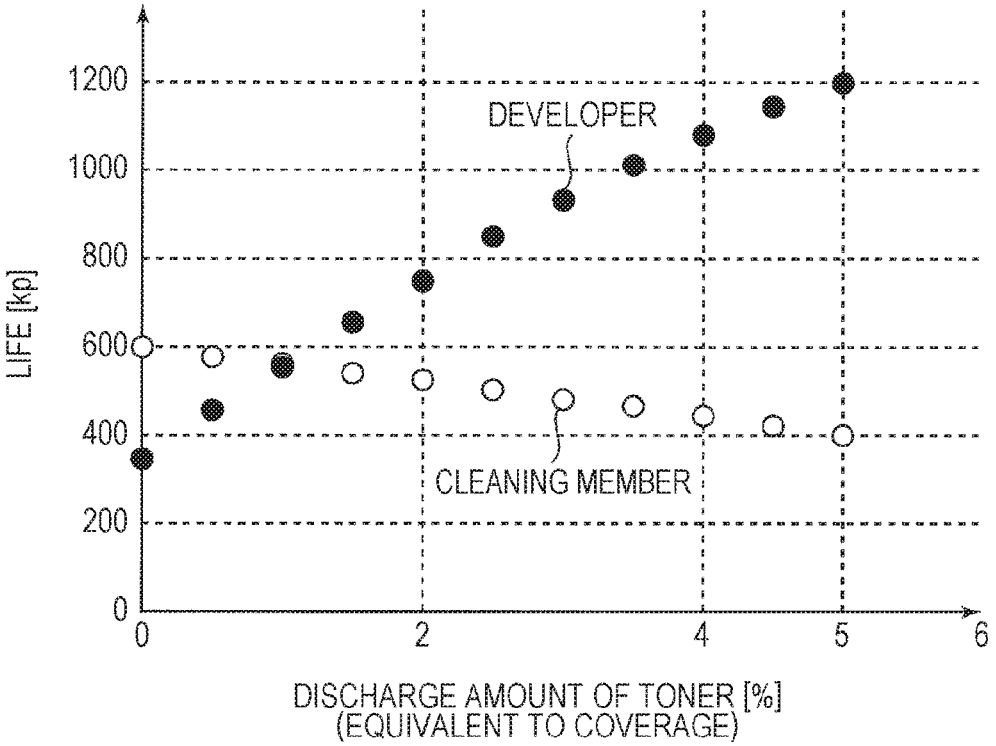
FIG. 3 illustrates one example of the relation between a toner discharge amount and lives of the developer and the cleaning member.

FIG. 3 illustrates one example of the relation between the toner discharge amount and the lives of the developer and the cleaning blade 226. In FIG. 3, the toner discharge amount on the horizontal axis is represented by coverage [%]. In FIG. 3, the toner discharge amount 0% means that the document coverage is 0% and no toner is discharged (discharge coverage is 0%). In addition, the toner discharge amount 5% means that the total of the toner consumption amount in image formation and the discharge amount of deteriorated toner corresponds to the coverage of 5%. For example, when the document coverage is 3%, it means that the deteriorated toner is discharged with the discharge coverage of 2%.

Actually, the discharge amount of the deteriorated toner varies depending on the document coverage. For this reason, the lives of the developer and the cleaning blade 226 at the time are estimated by calculating an average discharge amount (average value of the discharge coverage) of the deteriorated toner based on a result (past document coverage) of the image formation and assuming that an image is formed with the equivalent document coverage in the future.

In the example illustrated in FIG. 3, when a toner consumption amount per sheet due to the toner consumption through the image formation and the discharge of the deteriorated toner corresponds to the coverage of 5%, the developer has a life of 1200 kp (1.2 million sheets of paper), and the cleaning blade 226 has a life of 400 kp (0.4 million sheets of paper). In addition, when the toner consumption through image formation and the discharge of the deteriorated toner are not performed (the developer receives unilateral stress without being replaced), the developer has a life of less than 400 kp, and the cleaning blade 226 has a life of 600 kp. That is, as illustrated in FIG. 3, as the toner discharge amount increases, the developer has a longer life, and the cleaning blade 226 has a shorter life. In other words, when an image is formed with low coverage, the reduced discharge amount of the deteriorated toner shortens the life of the developer but lengthens the life of the cleaning blade 226.

Figure 4A:
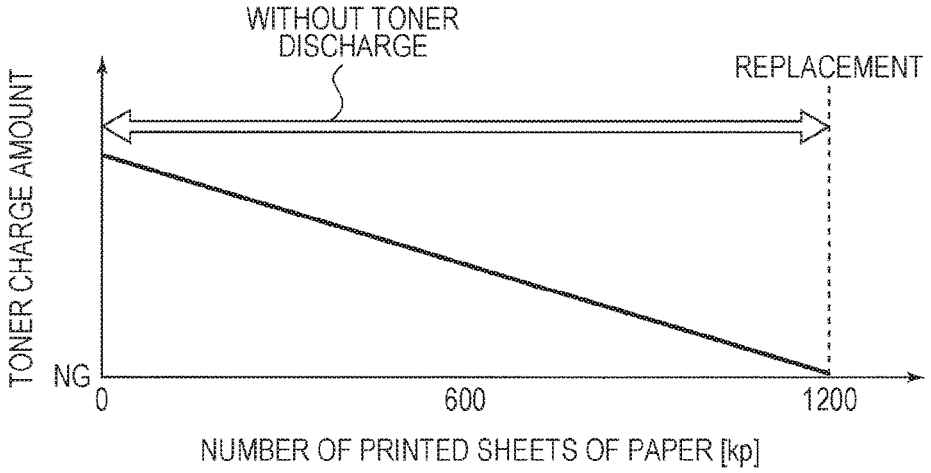
FIGS. 4A and 4B illustrate performance straight lines of the developer and the cleaning member in the case where toner is not discharged.
Figure 4B:
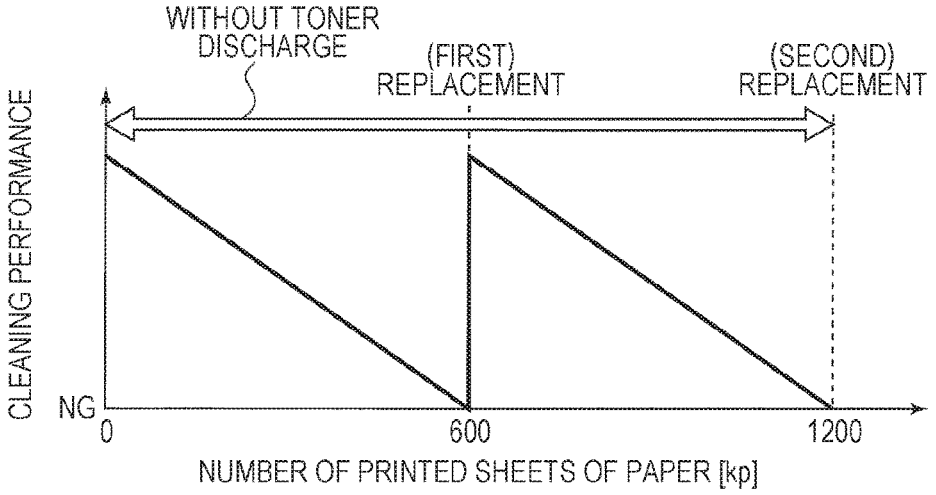

FIGS. 4A and 4B illustrate examples of performance straight lines of the developer and the cleaning blade 226. FIGS. 4A and 4B illustrate a case where the developer and the cleaning blade 226 have life characteristics as illustrated in FIG. 3 and an image is formed with the document coverage of 5% or more.

As illustrated in FIG. 4A, the toner charge amount of the developer is lowered with increase of the number of printed sheets of paper. The developer is replaced at the time when the toner charge amount reaches a predetermined value. Furthermore, as illustrated in FIG. 4B, cleaning performance of the cleaning blade 226 is deteriorated with increase of the number of printed sheets of paper. The cleaning performance of the cleaning blade 226 depends on (is inversely proportional to) the toner passage amount. The cleaning blade 226 is replaced at the time when the cleaning performance reaches a predetermined value.

As illustrated in FIGS. 4A and 4B, when an image is formed with the document coverage of 5% or more, no deteriorated toner is discharged, so that the developer is replaced at 1200 kp printing, and the cleaning blade 226 is replaced at 600 kp printing. The first replacement time of the developer and the second replacement time of the cleaning blade 226 thus overlap with each other, and the two can be replaced at the same time.

Figure 5A:
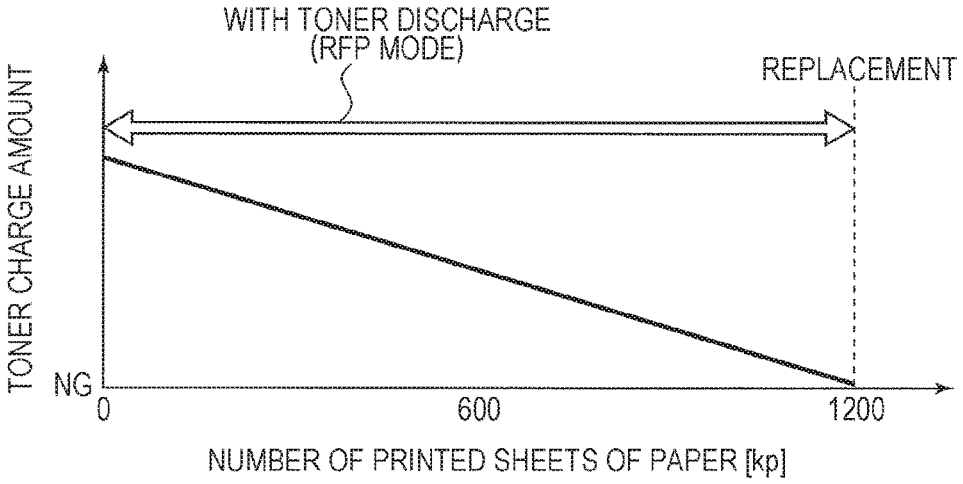
FIGS. 5A and 5B illustrate performance straight lines of the developer and the cleaning member in the case where toner is discharged in an RFP mode.
Figure 5B:
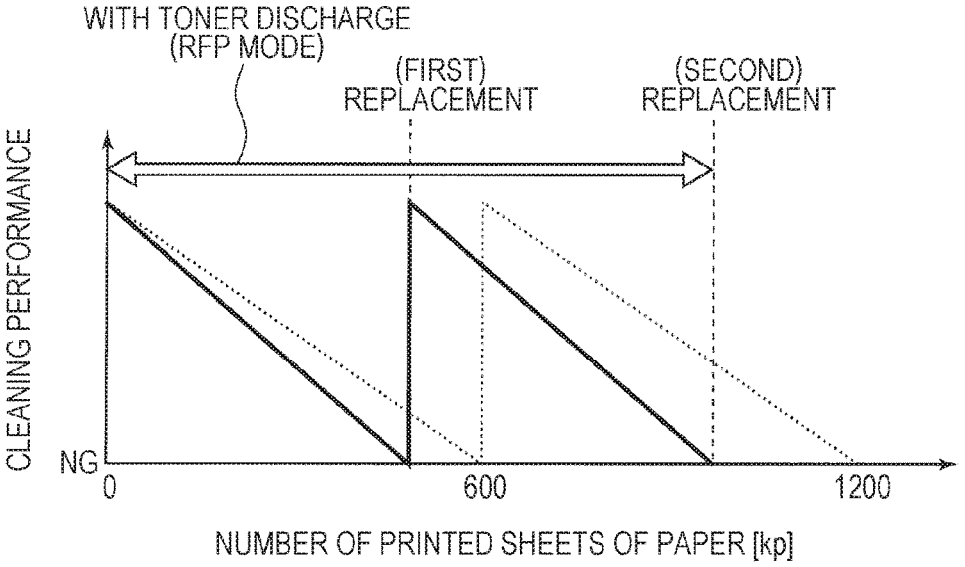

FIGS. 5A and 5B illustrate examples of the performance straight lines of the developer and the cleaning blade 226. FIGS. 5A and 5B illustrate a case where the developer and the cleaning blade 226 have life characteristics as illustrated in FIG. 3 and toner is discharged in the RFP mode.

As illustrated in FIG. 5A, the toner charge amount of the developer is lowered with increase of the number of printed sheets of paper in a manner similar to in the case where an image is formed with the document coverage of 5% or more and no toner is discharged (see FIG. 4A). Furthermore, as illustrated in FIG. 5B, the cleaning performance of the cleaning blade 226 is deteriorated with increase of the number of printed sheets of paper. The toner discharge puts a larger burden on the cleaning blade 226. The cleaning performance is deteriorated faster than in the case where toner is not discharged (indicated by a dotted line in FIG. 5B).

Figure 6A:
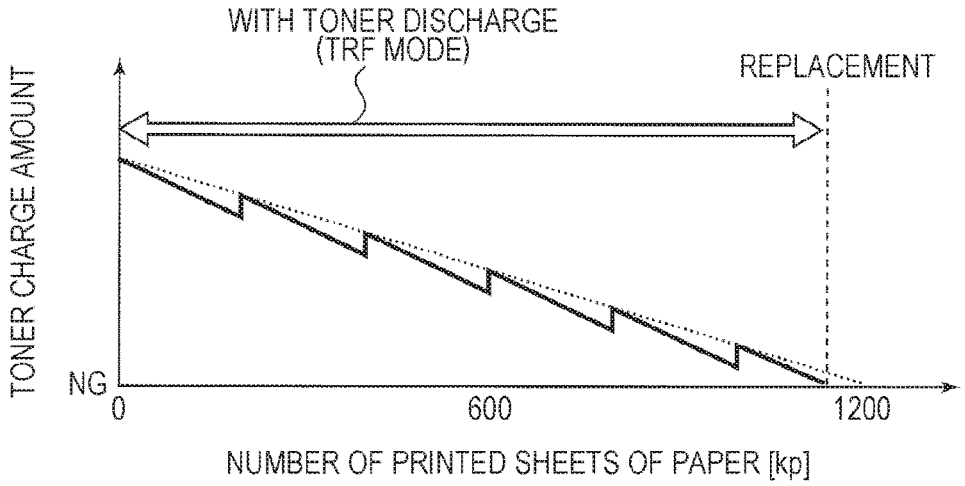
FIGS. 6A and 6B illustrate performance straight lines of the developer and the cleaning member in the case where toner is discharged in a toner refresh mode.
Figure 6B:
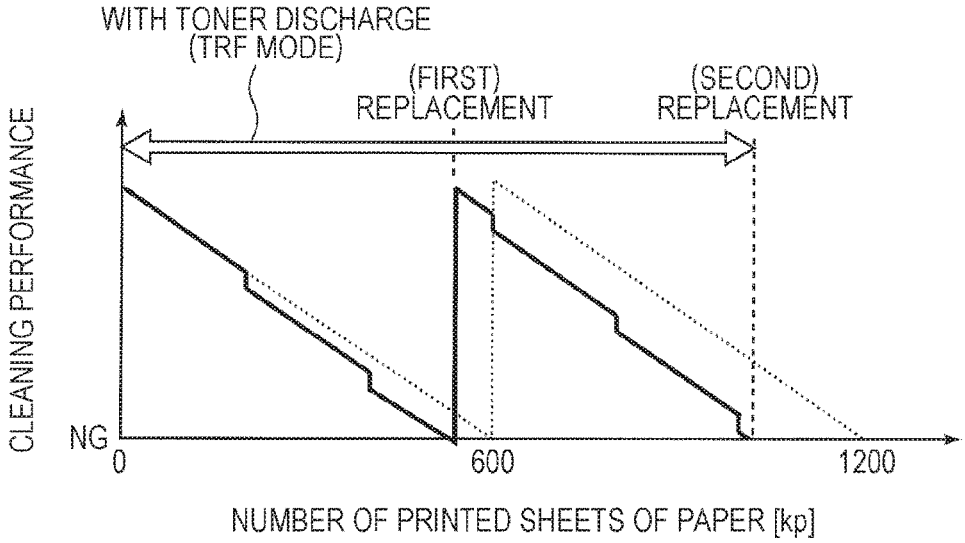

FIGS. 6A and 6B illustrate examples of the performance straight lines of the developer and the cleaning blade 226. FIGS. 6A and 6B illustrate a case where the developer and the cleaning blade 226 have life characteristics as illustrated in FIG. 3 and toner is discharged in the toner refresh mode. It should be noted that FIGS. 6A and 6B illustrate a 200 kp interval between toner discharge operations in the toner refresh mode.

As illustrated in FIG. 6A, the toner charge amount of the developer is lowered faster until the toner is discharged than in the case (indicated by a dotted line in FIG. 6A) where an image is formed with the document coverage of 5% or more or the target coverage of 5% is achieved by the toner discharge in the RFP mode, but rapidly recovered with the toner discharge. Furthermore, as illustrated in FIG. 6B, the cleaning performance of the cleaning blade 226 is deteriorated until the toner is discharged at a deterioration speed equivalent to that in the case (indicated by a dotted line in FIG. 6B) where an image is formed with the document coverage of 5% or more or the target coverage of 5% is achieved by the toner discharge in the RFP mode, but rapidly deteriorated with the toner discharge.

In addition, in the toner refresh mode, the longer interval between toner discharge operations needs a more discharge amount. The longer interval thus rapidly deteriorates the cleaning blade 226. In contrast, the shorter interval between toner discharge operations can inhibit the deterioration of the cleaning blade 226, and lengthen the life of the cleaning blade 226.

In such a manner, the image formation with low coverage (e.g., document coverage of 5% or less) leads to forcible discharge of the deteriorated toner. As a result, even when the lives of the developer and the cleaning blade 226 are set to accord with each other in an initial state, the cleaning blade 226 comes to the end of the life faster than the developer, and replacement times no longer overlap.

Here, as described above, reduction in the discharge amount of the deteriorated toner can lengthen the life of the cleaning blade 226. That is, the replacement time of the cleaning blade 226 can be postponed by adjusting the toner discharge condition (the condition related to the toner discharge amount and the condition related to the toner discharge timing). In the embodiment, the replacement time of the cleaning blade 226 and the replacement time of other consumables (particularly, the developer) are set to overlap as long as possible by adjusting the toner discharge condition and lengthening the life of the cleaning blade 226. This operation can save running cost including maintenance cost and consumable cost. Specifically, toner discharge control processing in the RFP mode and the toner refresh mode is performed according to the flowchart illustrated in FIG. 7 or 9.

Figure 7:
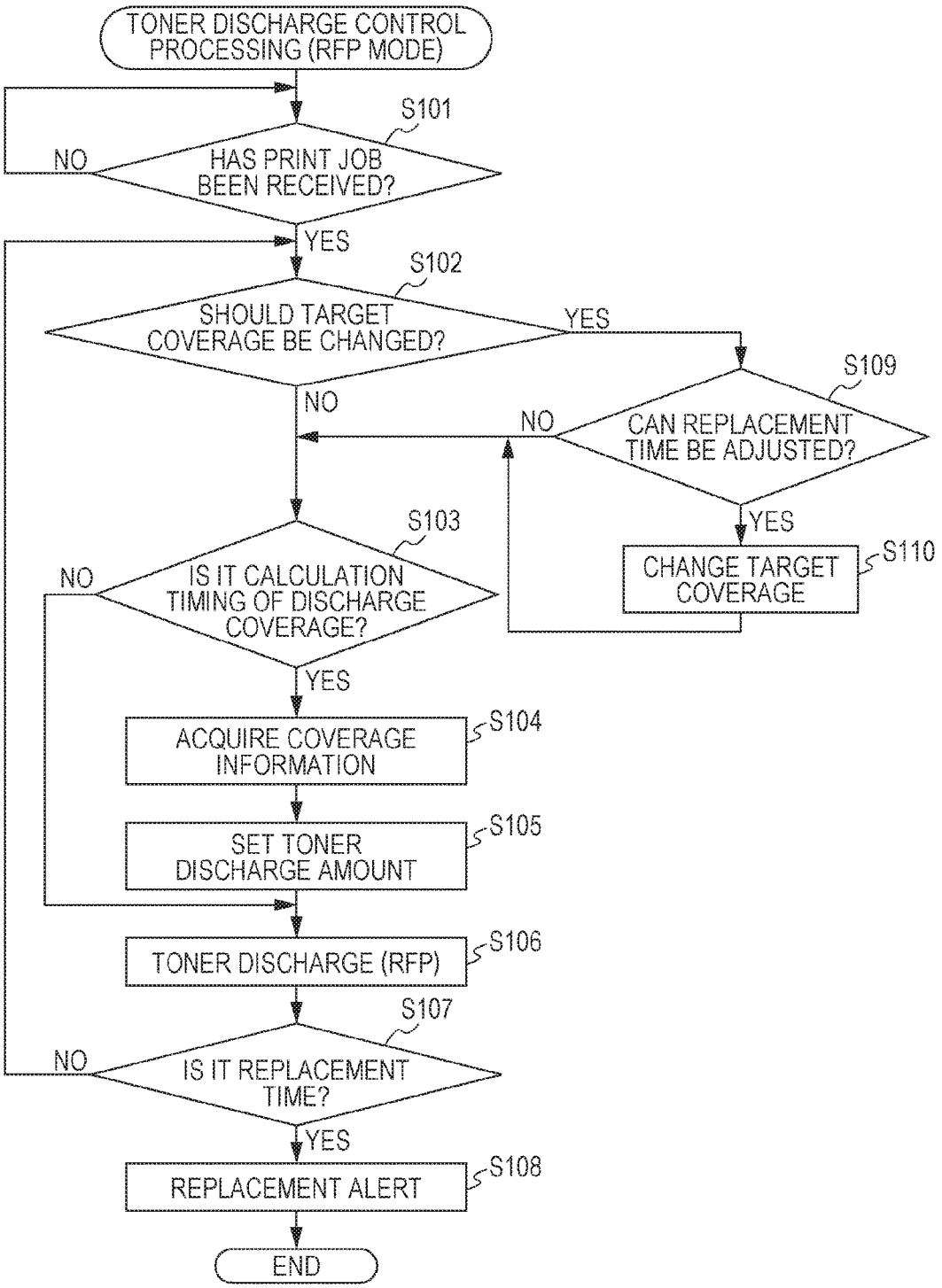
FIG. 7 is a flowchart illustrating one example of toner discharge control processing in the RFP mode.

FIG. 7 is a flowchart illustrating one example of the toner discharge control processing in the RFP mode. For example, the processing is performed by the CPU 31 executing a predetermined program store in the ROM 32 with turning-on of the image forming apparatus 1.

It should be noted that various parameters used in the toner discharge control processing are acquired with the turning-on of the image forming apparatus 1. The parameters include the total number of printed sheets of paper after the replacement of the developer and the cleaning blade 226, the number of printed sheets of paper from the previous toner discharge operation, a result of image formation (document coverage), and the lives of the developer and the cleaning blade 226. For example, these pieces of information are stored in the ROM 32.

In the RFP mode, a discharging toner image is formed between the sheets of paper to forcibly discharge the deteriorated toner each time one image is formed. The developer and the cleaning blade 226 are assumed to have the life characteristics as illustrated in FIGS. 3, 5A and 5B and the same start time of use. In the RFP mode, the target coverage is optimized as a condition related to the toner discharge amount, which is the toner discharge condition, in order to overlap the replacement times of the developer and the cleaning blade 226.

In Step S101 of FIG. 7, the controller 30 determines whether having received a print job. When the print job has not been received ("NO" in Step S101), the processing of Step S101 is repeated. When the print job has been received ("YES" in Step S101), the processing proceeds to Step S102. In addition, when receiving the print job, the controller 30 adds the number of printed sheets of paper for each image formation for which an instruction is given by the print job, and acquires the document coverage.

In Step S102, the controller 30 determines whether to perform change processing of the target coverage (condition related to the toner discharge amount). For example, the change processing of the target coverage is performed at the time when the remaining life of the developer or the cleaning blade 226 reaches a predetermined value. Here, the change processing of the target coverage is performed when the remaining life of the developer reaches 300 kp, that is, the total number of printed sheets of paper after the replacement of the developer reaches 900 kp. When the change processing of the target coverage is performed ("YES" in Step S102), the processing proceeds to Step S109. When the change processing of the toner discharge amount is not performed ("NO" in Step S102), the processing proceeds to Step S103.

In Step S103, the controller 30 determines whether it is calculation timing (e.g., 30 seconds) of the discharge coverage in the RFP mode. When it is the calculation timing of the discharge coverage ("YES" in Step S103), the processing proceeds to Step S104. When it is not the calculation timing of the discharge coverage ("NO" in Step S103), the processing proceeds to Step S106.

In Step S104, the controller 30 acquires coverage information. The coverage information is, for example, an average value of the document coverage in image formation performed after the calculation of the previous discharge coverage, and represents a toner consumption amount in image formation.

In Step S105, the controller 30 sets the toner discharge amount. Specifically, the discharge coverage is calculated such that the total of the document coverage and the discharge coverage reaches the target coverage of 5%. An amount corresponding to the discharge coverage is then set as the toner discharge amount. For example, the document coverage (average value) of 2% leads to the discharge coverage of 3%. It should be noted that the target coverage is changed in Step S110, the discharge coverage is calculated based on the changed target coverage and the document coverage to set the toner discharge amount.

In Step S106, the controller 30 controls the toner discharge operation. Specifically, the controller 30 forms a black solid toner band (discharging toner image) in a plurality of areas between sheets of paper, and discharges the deteriorated toner in the toner discharge amount set in Step S105.

In Step S107, the controller 30 determines whether the replacement time of the developer or the cleaning blade 226 has come. The replacement times of the developer and the cleaning blade 226 are calculated based on the toner consumption amount in the image formation and the discharge amount of the deteriorated toner. It should be noted that the replacement time of the cleaning blade 226 mainly depends on the discharge amount of the deteriorated toner. When the replacement time of the developer or the cleaning blade 226 has come ("YES" in Step S107), the processing proceeds to Step S108. When the replacement time of the developer and the cleaning blade 226 has not come ("NO" in Step S107), the processing proceeds to Step S102. It should be noted that, when the print job is finished before the replacement time comes, the processing proceeds to Step S101.

In Step S108, the controller 30 outputs a replacement alert indicating that the replacement time of the developer or the cleaning blade 226 has come. The replacement alert is output, for example, by display on the display 121 or sound from a sound outputter (not illustrated).

In Step S109, the controller 30 determines whether the replacement time of the cleaning blade 226 can be set at the same time as the replacement time of the developer by adjustment of the toner discharge amount. For example, the controller 30 compares the replacement time of the cleaning blade 226 in the case where the toner is not discharged and the deterioration is minimized to the replacement time of the developer at this time. When the difference between the replacement time of the cleaning blade 226 and the replacement time of the developer is equal to or less than a predetermined value (including the case where the replacement time is reversed), the controller 30 determines that the replacement times can be set at the same time.

When the replacement time of the cleaning blade 226 can be overlapped with the replacement time of the developer ("YES" in Step S109), the processing proceeds to Step S110. When the replacement time of the cleaning blade 226 cannot be overlapped with the replacement time of the developer ("NO" in Step S109), the processing proceeds to Step S103. When the replacement time of the cleaning blade 226 cannot be overlapped with the replacement time of the developer, the target coverage is not changed, and the discharge coverage is set as before.

In Step S110, the controller 30 sets the target coverage so that the replacement time of the cleaning blade 226 overlaps with the replacement time of the developer. For example, the controller 30 estimates the replacement times of the developer and the cleaning blade 226 in the case where the discharge coverage is gradually decreased based on an initial discharge coverage (here, a value at which the target coverage of 5% is achieved). The controller 30 then set the target coverage based on the discharge coverage in the case where the replacement time (life) of the developer and the replacement time (life) of the cleaning blade 226 are closest.

Table 1 illustrates one example of estimated replacement times of the developer and the cleaning blade 226 in the case where the discharge coverage (toner discharge amount) is gradually decreased. Table 1 illustrates a case where the target coverage is changed at the time when the remaining life of the developer reaches 300 kp, that is, the total number of printed sheets of paper after replacement of the developer reaches 900 kp. In addition, Table 1 illustrates the case where the average discharge coverage is set at 3% from a past result in order to achieve the target coverage of 5% (case of the average document coverage of 2%). It should be noted that Table 1 illustrates the second replacement time of the cleaning blade 226 in the case where the first replacement of the cleaning blade 226 has been performed at the time when the number of printed sheets of paper reached 480 kp by the total number of printed sheets of paper from the beginning.

TABLE 1

| Magnification | 1.0 | 0.9 | 0.8 | 0.7 | 0.6 | 0.5 | 0.4 | 0.3 | 0.2 | 0.1 | 0 |
|---|---|---|---|---|---|---|---|---|---|---|---|
| LD [kp] | 1200 | 1188 | 1173 | 1155 | 1135 | 1113 | 1088 | 1063 | 1038 | 1013 | 988 |
| LC [kp] | 960 | 963 | 975 | 987 | 999 | 1011 | 1023 | 1035 | 1047 | 1059 | 1071 |
| Difference [kp] | 240 | 225 | 196 | 168 | 136 | 102 | 65 | 28 | −9 | −46 | −83 |

LD: Replacement time of developer
LC: Replacement time of cleaning blade 226

Table 1 illustrates the replacement times of the developer and the cleaning blade 226 in the case where the discharge coverage is gradually decreased by multiplying the initial discharge coverage of 3% (magnification of 1.0), which serves as a standard, by a predetermined magnification (magnification of 0.9 to 0). For example, the discharge coverage in the case of the magnification of 0.4 is 3×0.4=1.2 [%], and the discharge coverage in the case of the magnification of 0.7 is 3×0.7=2.1[%].

According to Table 1, when the deteriorated toner is discharged with the discharge coverage of 3% also in the future and the target coverage of 5% is achieved, the replacement time of the developer comes at 1200 kp printing time, and the replacement time of the cleaning blade 226 comes at 960 kp printing time. In contrast, when the discharge coverage is reduced, that is, when the target coverage is decreased, the replacement time of the developer comes earlier, and the replacement time of the cleaning blade 226 comes later.

In Table 1, the replacement time of the developer and the replacement time of the cleaning blade 226 are closest at the magnification of 0.2. That is, when the deteriorated toner is discharged with a discharge coverage of 3×0.2=0.6[%], the replacement time of the developer and the replacement time of the cleaning blade 226 are closest. In Step S110 of FIG. 7, the target coverage with which the document coverage is 2% and the discharge coverage is 0.6%, that is, 2+0.6=2.6 [%] is thus set as a future target coverage.

Figure 8A:
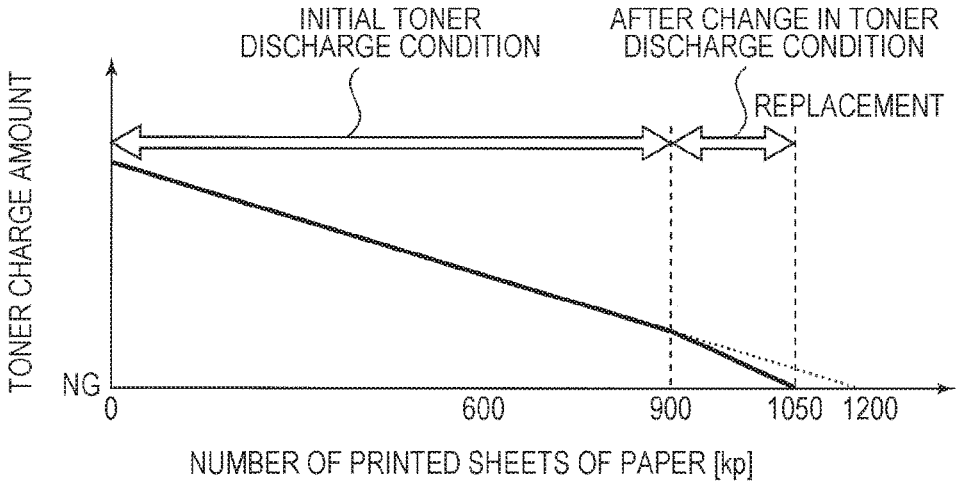
FIGS. 8A and 8B illustrate performance straight lines of the developer and the cleaning member in the case where a toner discharge amount is changed in the RFP mode.
Figure 8B:
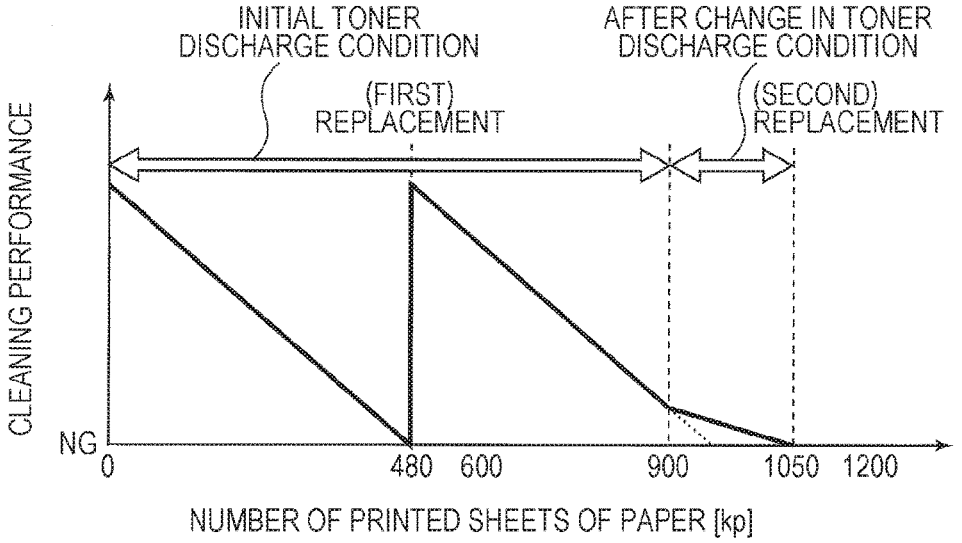

When the target coverage is changed in Step S110 of FIG. 7, the discharge coverage is calculated based on the changed target coverage and the document coverage from that point, and the deteriorated toner is discharged in the toner discharge amount corresponding to the discharge coverage. FIGS. 8A and 8B illustrate performance straight lines of the developer and the cleaning blade 226 at the time. In FIGS. 8A and 8B, a solid line indicates the performance straight line after the target coverage is changed, and a dotted line indicates the performance straight line before the target coverage is changed. As illustrated in FIGS. 8A and 8B, when the target coverage is changed, the replacement times of the developer and the cleaning blade 226 overlap with each other at the same time. Both thus can be replaced at the same time, whereby maintenance cost can be greatly reduced.

In this way, the image forming apparatus 1 has the RFP mode (first toner discharge mode) executed between sheets of paper at the first toner discharge timing. The controller 30 changes the target coverage (condition related to the toner discharge amount) in the RFP mode such that the replacement time of the cleaning blade 226 overlaps with the replacement time of the developer.

The replacement time of the cleaning blade 226 can be overlapped with the replacement time of the developer by changing the target coverage to extend the replacement time of the cleaning blade 226 and quicken the replacement time of the developer. As a result, replacement times of the developer and the cleaning blade 226 come at the same period, and the developer and the cleaning blade 226 can be replaced at the same time, whereby running cost can be reduced.

It should be noted that, although developer cost is increased by the quickened replacement time in view of only the developer, a service man is required to pay a visit for the replacement only once. Considering that the maintenance cost can be reduced, total miming cost can be reduced.

As described above, when the target coverage is set such that the difference between the replacement time of the developer and the replacement time of the cleaning blade 226 is minimized, the effect of reducing the running cost is maximized. When the decrease in the maintenance cost due to simultaneous replacements of the developer and the cleaning blade 226 exceeds the increase in the developer cost due to the quickened replacement time, however, the running cost can be reduced only by decreasing the target coverage below an initial value to bring the replacement time of the developer and the replacement time of the cleaning blade 226 close to each other.

In the above-described example, although the target coverage is changed at the time when the remaining life of the developer reaches 300 kp, the times when the change processing of the target coverage is performed may be dispersed. In addition, after the target coverage is changed, the target coverage may be updated according to the document coverage in the subsequent image formation. This enables the replacement times of the developer and the cleaning blade 226 to overlap precisely.

Figure 9:
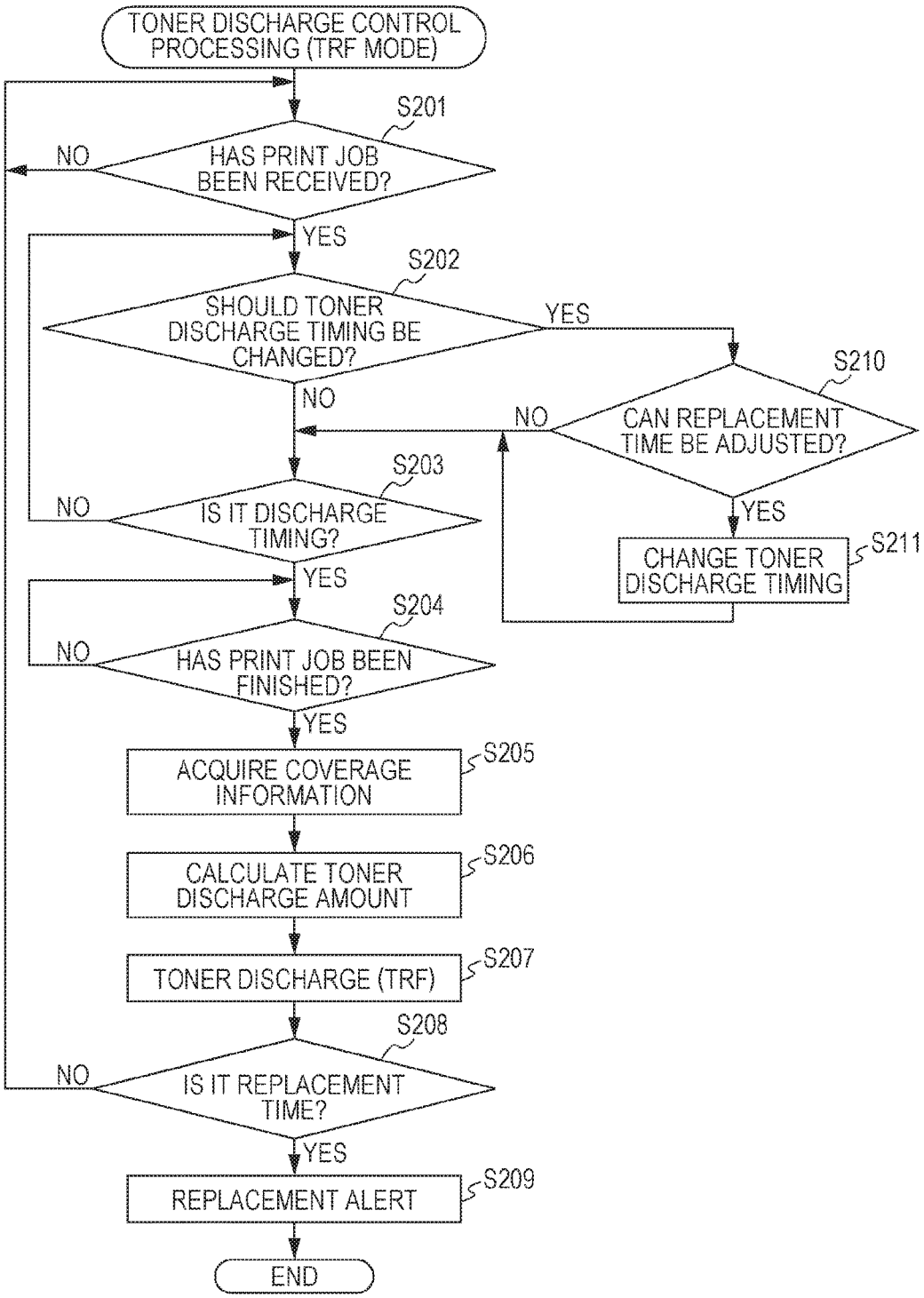
FIG. 9 is a flowchart illustrating one example of the toner discharge control processing in the toner refresh mode.

FIG. 9 is a flowchart illustrating one example of the toner discharge control processing in the toner refresh mode (represented as "TRF mode" in FIG. 9). For example, the processing is performed by the CPU 31 executing a predetermined program store in the ROM 32 with turning-on of the image forming apparatus 1.

It should be noted that various parameters used in the toner discharge control processing are acquired with the turning-on of the image forming apparatus 1. The parameters include the total number of printed sheets of paper after the replacement of the developer and the cleaning blade 226, the number of printed sheets of paper from the previous toner discharge operation, a result of image formation (document coverage), and the lives of the developer and the cleaning blade 226. For example, these pieces of information are stored in the ROM 32.

In the toner refresh mode, a discharging toner image is formed on the intermediate transfer belt 221 to forcibly discharge the deteriorated toner between jobs. The developer and the cleaning blade 226 are assumed to have the life characteristics as illustrated in FIGS. 3, 6A and 6B and the same start time of use. In the toner refresh mode, the second toner discharge timing, which is the toner discharge condition, is optimized in order to overlap the replacement times of the developer and the cleaning blade 226.

In Step S201 of FIG. 9, the controller 30 determines whether having received a print job. When the print job has not been received ("NO" in Step S201), the processing of Step S201 is repeated. When the print job has been received ("YES" in Step S201), the processing proceeds to Step S202. In addition, when receiving the print job, the controller 30 adds the number of printed sheets of paper for each image formation for which an instruction is given by the print job, and acquires the document coverage.

In Step S202, the controller 30 determines whether to perform change processing of the toner discharge timing. For example, the change processing of the toner discharge timing is performed at the time when the remaining life of the developer or the cleaning blade 226 reaches a predetermined value. Here, the change processing of the toner discharge amount is performed when the remaining life of the developer reaches 400 kp, that is, the total number of printed sheets of paper after the replacement of the developer reaches 800 kp. When the change processing of the toner discharge timing is performed ("YES" in Step S202), the processing proceeds to Step S210. When the change processing of the toner discharge timing is not performed ("NO" in Step S202), the processing proceeds to Step S203.

In Step S203, the controller 30 determines whether it is the timing (second toner discharge timing) when the toner discharge operation in the toner refresh mode is performed. In the embodiment, the second toner discharge timing comes at each 200 kp. When it is the second toner discharge timing ("YES" in Step S203), the processing proceeds to Step S204. When it is not the second toner discharge timing ("NO" in Step S203), the processing proceeds to Step S202. It should be noted that, when the print job is finished before the second toner discharge timing comes, the processing proceeds to Step S201.

In Step S204, the controller 30 determines whether a series of pieces of image formation for which an instruction is given by the current print job has been finished. When the current print job has not been finished ("NO" in Step S204), the processing of Step S204 is repeated. When the current print job has been finished ("YES" in Step S204), the processing proceeds to Step S205.

In Step S205, the controller 30 acquires coverage information. The coverage information is, for example, an average value of the document coverage in image formation performed after the previous toner discharge, and represents a toner consumption amount in image formation.

In Step S206, the controller 30 sets the toner discharge amount. Specifically, the discharge coverage is calculated such that the total of the document coverage and the discharge coverage reaches the target coverage of 5%. An amount corresponding to the discharge coverage is then set as the toner discharge amount. For example, the document coverage (average value) of 2% leads to the discharge coverage of 3%. It should be noted that, when the document coverage is detected to be 5% or less in the image formation performed after the previous toner discharge operation, the toner amount (insufficient discharge amount) corresponding to the difference from 5% may be integrated so that the integrated value is set as the toner discharge amount.

In Step S207, the controller 30 controls the toner discharge operation. Specifically, the controller 30 forms a black solid toner band (discharging toner image) between jobs, and collectively discharges the deteriorated toner in the toner discharge amount calculated in Step S206.

In Step S208, the controller 30 determines whether the replacement time of the developer or the cleaning blade 226 has come. The replacement times of the developer and the cleaning blade 226 are calculated based on the toner consumption amount in the image formation and the discharge amount of the deteriorated toner. It should be noted that the replacement time of the cleaning blade 226 mainly depends on the discharge amount of the deteriorated toner. When the replacement time of the developer or the cleaning blade 226 has come ("YES" in Step S208), the processing proceeds to Step S209. When the replacement times of the developer and the cleaning blade 226 have not come ("NO" in Step S208), the processing proceeds to Step S201.

In Step S209, the controller 30 outputs a replacement alert indicating that the replacement time of the developer or the cleaning blade 226 has come. The replacement alert is output, for example, by display on the display 121 or sound from a sound outputter (not illustrated).

In Step S210, the controller 30 determines whether the replacement time of the cleaning blade 226 can be set at the same time as the replacement time of the developer by adjustment of the toner discharge amount. For example, the controller 30 compares the replacement time of the cleaning blade 226 in the case where an interval between toner discharge operations is set to half of the past interval to the replacement time of the developer at this time. When the difference between the replacement time of the cleaning blade 226 and the replacement time of the developer is equal to or less than a predetermined value (including the case where the replacement time is reversed), the controller 30 determines that the replacement times can be set at the same time.

When the replacement time of the cleaning blade 226 can be overlapped with the replacement time of the developer ("YES" in Step S210), the processing proceeds to Step S211. When the replacement time of the cleaning blade 226 cannot be overlapped with the replacement time of the developer ("NO" in Step S210), the processing proceeds to Step S203. When the replacement time of the cleaning blade 226 cannot be overlapped with the replacement time of the developer, the toner discharge timing is not changed, and the toner is discharged at the same toner discharge timing as before.

In Step S211, the controller 30 sets the toner discharge timing (second toner discharge timing) such that the replacement time of the cleaning blade 226 overlaps with the replacement time of the developer. For example, the controller 30 estimates the replacement times of the developer and the cleaning blade 226 in the case where the toner discharge timing is gradually quickened based on the initial toner discharge timing. The controller 30 then determines the case where the replacement time (life) of the developer and the replacement time (life) of the cleaning blade 226 are closest as the next toner discharge timing.

Table 2 illustrates one example of estimated replacement times of the developer and the cleaning blade 226 in the case where the toner discharge timing is gradually quickened. Table 2 illustrates a case where the toner discharge timing is changed at the time when the remaining life of the developer reaches 400 kp, that is, the total number of printed sheets of paper after replacement of the developer reaches 800 kp. Table 2 also illustrates the case where the average discharge coverage is set at 3% (case of the average document coverage of 2%) from a past result in order to achieve the target coverage of 5%.

TABLE 2

| Performed time [kp] | 1000 | 990 | 980 | 970 | 960 | 950 | 940 | 930 | 920 | 910 | 900 |
|---|---|---|---|---|---|---|---|---|---|---|---|
| LD [kp] | 1200 | 1190 | 1180 | 1170 | 1160 | 1150 | 1140 | 1130 | 1120 | 1110 | 1100 |
| LC [kp] | 1040 | 1048 | 1056 | 1064 | 1072 | 1080 | 1088 | 1096 | 1104 | 1112 | 1120 |
| Difference [kp] | 160 | 142 | 124 | 106 | 88 | 70 | 52 | 34 | 16 | −2 | −20 |

LD: Replacement time of developer
LC: Replacement time of cleaning blade 226

Table 2 illustrates the replacement times of the developer and the cleaning blade 226 when the toner discharge timing is quickened by 10 kp based on the initial toner discharge timing, that is, the time when the number of printed sheets of paper reaches 1000 kp.

According to Table 2, when the next toner discharge is performed at the time when the number of printed sheets of paper reaches 1000 kp, the replacement time of the developer comes at 1200 kp printing time, and the replacement time of the cleaning blade 226 comes at 1040 kp printing time. In contrast, when the toner discharge timing is quickened, the replacement time of the developer comes earlier, and the replacement time of the cleaning blade 226 comes later.

In Table 2, when the next toner discharge is performed at the time when the number of printed sheets of paper reaches 910 kp, the replacement time of the developer and the replacement time of the cleaning blade 226 are closest. In Step S211 of FIG. 9, the 910 kp printing time is thus set as the next toner discharge timing.

Figure 10A:
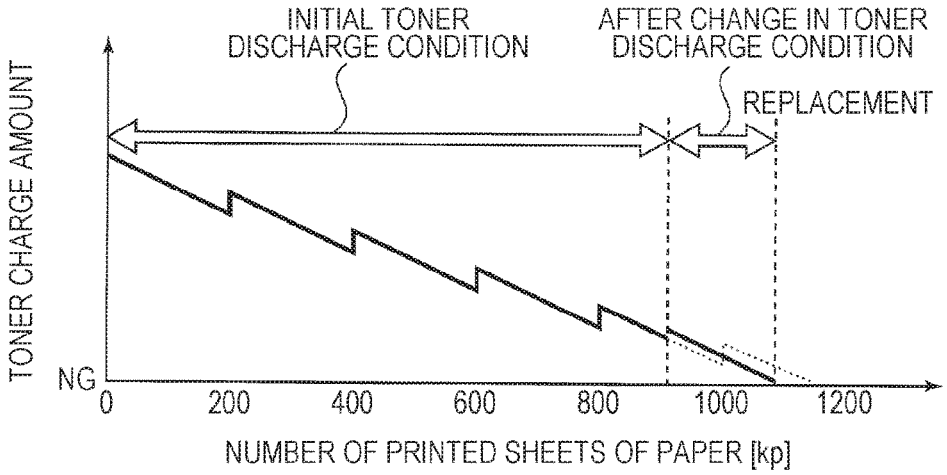
FIGS. 10A and 10B illustrate performance straight lines of the developer and the cleaning member in the case where toner discharge timing is changed in the toner refresh mode.
Figure 10B:
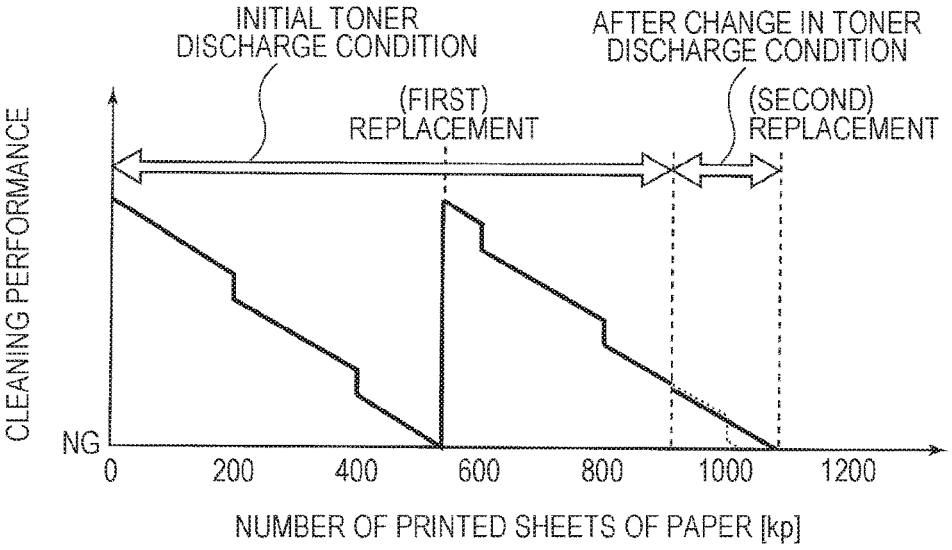

When the toner discharge timing is changed in Step S211 of FIG. 9, the next toner discharge is performed at the time when the number of printed sheets of paper reaches 910 kp. FIGS. 10A and 10B illustrate performance straight lines of the developer and the cleaning blade 226 at the time. In FIGS. 10A and 10B, a solid line indicates the performance straight line in the case where the toner discharge timing is changed, and a dotted line indicates the performance straight line in the case where the toner discharge timing is not changed. As illustrated in FIGS. 10A and 10B, when the toner discharge timing is changed, the replacement times of the developer and the cleaning blade 226 overlap at the same time. Both thus can be replaced at the same time, whereby maintenance cost can be greatly reduced.

It should be noted that, as illustrated in FIGS. 10A and 10B, when the interval between toner discharge operations in the toner refresh mode is quickened, that is, toner is discharged earlier than the initial toner discharge timing, the toner discharge amount is reduced. Consequently, the recovery of the toner charge amount is reduced, and the deterioration of the cleaning performance of the cleaning blade 226 is also reduced.

In this way, the image forming apparatus 1 has the toner refresh mode (second toner discharge mode) executed between jobs at the second toner discharge timing. The controller 30 changes the second toner discharge timing in the toner refresh mode such that the replacement time of the cleaning blade 226 overlaps with the replacement time of the developer.

In the toner refresh mode, the replacement time of the cleaning blade 226 can be overlapped with the replacement time of the developer by changing the toner discharge timing to extend the replacement time of the cleaning blade 226 and quicken the replacement time of the developer. As a result, replacement times of the developer and the cleaning blade 226 come at the same period, and the developer and the cleaning blade 226 can be replaced at the same time, whereby running cost can be reduced.

It should be noted that, although developer cost is increased by the quickened replacement time in view of only the developer, a service man is required to pay a visit for the replacement only once. Considering that the maintenance cost can be reduced, total running cost can be reduced.

As described above, when the next toner discharge timing is set such that the difference between the replacement time of the developer and the replacement time of the cleaning blade 226 is minimized, the effect of reducing the running cost is maximized. When the decrease in the maintenance cost due to simultaneous replacements of the developer and the cleaning blade 226 exceeds the increase in developer cost due to the quickened replacement time, however, the running cost can be reduced only by quickening the next toner discharge timing compared to the initial toner discharge timing to bring the replacement time of the developer and the replacement time of the cleaning blade 226 close to each other.

In the above-described example, although the toner discharge timing is changed at the time when the remaining life of the developer reaches 400 kp, the times when the change processing of the toner discharge timing is performed may be dispersed.

As described above, the image forming apparatus 1 includes the intermediate transfer belt 221 (image carrier), the developing device 212 (developing part), the secondary transferor (transferor), the cleaning blade 226, and the controller 30. The intermediate transfer belt 221 carries a toner image. The developing device 212 accommodates two-component developer containing toner and a carrier, and supplies the toner to the intermediate transfer belt 221. The secondary transferor transfers the toner image on the intermediate transfer belt 221 onto paper. The cleaning blade 226 removes toner remaining on the intermediate transfer belt 221. The controller 30 controls toner discharge operation in the developing device 212 according to a toner discharge condition. The controller 30 sets the toner discharge condition such that the replacement time of the cleaning blade 226 overlaps with the replacement time of the developer (or another consumable).

The image forming apparatus 1 can overlap the replacement time of the cleaning blade 226 with the replacement time of the developer. Maintenance cost can thus be greatly reduced, and running cost of the image forming apparatus 1 can be reduced.

Although the invention made by the present inventor has been specifically described above based on the embodiment, the invention is not limited to the above embodiment, and can be modified without departing from the spirit of the invention.

For example, although, in the embodiment, the case where the replacement time of the cleaning blade 226 is overlapped with the replacement time of the developer by changing the toner discharge condition has been described, the replacement time of the cleaning blade 226 may be overlapped with the replacement time of another consumable (e.g., charging electrode of the charging device 214). In the case where the replacement times of the developer and the cleaning blade 226 greatly differ, such as a case where the developer is replaced halfway due to, for example, a trouble, overlapping the replacement time of the developer with that of the cleaning blade 226 is difficult. Maintenance cost, however, can be greatly reduced by overlapping the replacement time of the cleaning blade 226 with the replacement time of another consumable.

For example, in the embodiment, the change processing of the toner discharge condition (toner discharge amount or toner discharge timing) is performed when the period until the replacement time of the developer (remaining life) reaches a predetermined value, but the change processing of the toner discharge condition may be performed when the period until the replacement time of the cleaning blade 226 reaches a predetermined value.

Although, in the embodiment, the case where the invention is applied to color image forming apparatus of an intermediate transfer system has been described, the invention can be applied to an image forming apparatus of a direct transfer system or a monochrome image forming apparatus. It should be noted that, in the image forming apparatus of a direct transfer system, the photosensitive drum corresponds to the image carrier.

Although embodiments of the present invention have been described and illustrated in detail, the disclosed embodiments are made for purposes of illustration and example only and not limitation. The scope of the present invention should be interpreted by terms of the appended claims, and it is intended that all modifications which fall within the meaning and scope equivalent to the claims are included within the scope of the invention.

What is claimed is:

1. An image forming apparatus comprising:

an image carrier that carries a toner image;

a developing part that accommodates two-component developer containing toner and a carrier, and supplies the toner to the image carrier;

a transferor that transfers the toner image on the image carrier onto paper;

a cleaning member that removes the toner remaining on the image carrier; and a hardware processor that controls toner discharge operation in the developing part according to a toner discharge condition, wherein the hardware processor sets the toner discharge condition so that a replacement time of the cleaning member overlaps with a replacement time of another consumable.

2. The image forming apparatus according to claim 1, wherein the hardware processor sets the toner discharge condition so that the replacement time of the cleaning member overlaps with a replacement time of the developer.

3. The image forming apparatus according to claim 1, wherein the hardware processor changes the toner discharge condition so that a difference between the replacement time of the cleaning member and the replacement time of the other consumable is reduced compared to a difference in a case where the toner discharge operation is performed according to the toner discharge condition at a beginning.

4. The image forming apparatus according to claim 3, wherein the hardware processor changes the toner discharge condition so that the difference between the replacement time of the cleaning member and the replacement time of the other consumable is minimized when the toner discharge condition is gradually changed based on the toner discharge condition at the beginning.

5. The image forming apparatus according to claim 1, wherein the toner discharge condition includes a condition related to a toner discharge amount in the toner discharge operation and a condition related to toner discharge timing when the toner discharge operation is performed, the toner discharge operation includes a first toner discharge mode performed between sheets of paper at first toner discharge timing, and the hardware processor changes a condition related to the toner discharge amount in the first toner discharge mode.

6. The image forming apparatus according to claim 1, wherein the toner discharge condition includes a condition related to a toner discharge amount in the toner discharge operation and a condition related to toner discharge timing when the toner discharge operation is performed, the toner discharge operation includes a second toner discharge mode performed between jobs at second toner discharge timing, and the hardware processor changes the second toner discharge timing.

7. The image forming apparatus according to claim 1, wherein the hardware processor changes the toner discharge condition when a period until a replacement time of one of the developer and the cleaning member reaches a predetermined value or less.

8. A method of discharging toner in an image forming apparatus, the image forming apparatus including:

an image carrier that carries a toner image;

a developing part that accommodates two-component developer containing toner and a carrier, and supplies the toner to the image carrier;

a transferor that transfers the toner image on the image carrier onto paper; and a cleaning member that removes the toner remaining on the image carrier, the method comprising:

controlling toner discharge operation in the developing part according to a toner discharge condition; and setting the toner discharge condition so that a replacement time of the cleaning member overlaps with a replacement time of another consumable.

9. A non-transitory recording medium storing a computer readable program causing a computer in an image forming apparatus to perform:

controlling toner discharge operation in a developing part according to toner discharge condition; and setting the toner discharge condition so that a replacement time of a cleaning member overlaps with a replacement time of another consumable, the image forming apparatus including:

an image carrier that carries a toner image;

the developing part that accommodates two-component developer containing toner and a carrier, and supplies the toner to the image carrier;

a transferor that transfers the toner image on the image carrier onto paper; and the cleaning member that removes the toner remaining on the image carrier.

* * * * *